US005283401A

United States Patent [19]

Schmucker

[11] Patent Number: 5,283,401

[45] Date of Patent: Feb. 1, 1994

[54] MULTIPLE SWITCH ASSEMBLY INCLUDING LOCKABLE AND/OR VERTICALLY MOVABLE SWITCH ACTUATOR

[76] Inventor: Charles J. Schmucker, 2217 Mediterranean, Arlington, Tex. 76011

[21] Appl. No.: 923,104

[22] Filed: Jul. 30, 1992

[51] Int. Cl.[5] ..... H01H 25/00

[52] U.S. Cl. ..... 200/6 A

[58] Field of Search ..... 200/5 A, 6 A, 339

[56] References Cited

U.S. PATENT DOCUMENTS

| | | | |
|---|---|---|---|
| 4,246,452 | 1/1981 | Chandler | 200/5 A |
| 4,395,134 | 7/1983 | Luce | 368/3 |
| 4,687,200 | 8/1987 | Shirai | 273/148 B |
| 4,896,003 | 1/1990 | Hsieh | 200/6 A |
| 4,992,631 | 2/1991 | Gee | 200/5 A |

*Primary Examiner*—J. R. Scott

*Attorney, Agent, or Firm*—Warren B. Kice; David L. McCombs

[57] ABSTRACT

A manual control device for selectively actuating one or more switches in a multiswitch system. The device is utilized in cooperation with a video entertainment system, multimedia game device or other type system requiring a hand-actuated control apparatus. The device includes a housing, a plurality of switches disposed in the housing and being actuatable upon engagement, a switch actuator mounted in the housing and a plunger forming with said switch actuator a fulcrum to limit movement of the actuator in a manner to provide selective engagement and actuation of the switches, while permitting simultaneous engagement and actuation of selective pairs of the switches to provide different outputs. The device is operable to actuate switches individually or in adjacent pairs. The device is capable of both direct and tilt methods of operation such that in the tilt method the tilting movement for switch actuation is less than that required in the direct method.

16 Claims, 3 Drawing Sheets

MULTIPLE SWITCH ASSEMBLY INCLUDING LOCKABLE AND/OR VERTICALLY MOVABLE SWITCH ACTUATOR

CROSS-REFERENCE TO RELATED APPLICATION

This application relates to copending design patent application Ser. No. 814,664, entitled HAND CONTROLLER FOR MULTIMEDIA SYSTEM, filed on 30 Dec. 1991, assigned to the assignee of the present application and incorporated herein by reference.

FIELD OF THE INVENTION

The invention relates generally to a multiswitch system, and, more particularly, to a manual control device including a multidirectional actuator which selectively actuates multiple switches in response to declination or tilt of the actuator in particular directions.

BACKGROUND OF THE INVENTION

The use of a manual control device, such as a joystick, in a hand-held game-playing apparatus involving multiple switches is generally known. The device typically involves an actuator, usually in the form of a lever or the like, which controls various commands including the positioning (along a standard two-dimensional X and Y axis) of an image on a television screen. The lever is typically limited to two-dimensional motion by the support or pivot on which the lever turns and the motion is translated into an electrical signal via selected electrical components, such as potentiometers, switches, or piezoelectric transducers.

A typical prior-art control device includes a switch actuator in the shape of a cross with four lever arms that are adapted to actuate four switches respectively disposed beneath the lever arms. Normally, when the lever arms are not being pressed, the four switches are in an open or nonconductive state. Similarly, if one of the lever arms is pressed, the respective switch is closed or short-circuited and thereby commands one of four predetermined horizontal or vertical directions. In hand controllers for video games and multimedia systems, however, it is desirable for the manual control device to be capable of commanding more than four possible directions.

Furthermore, in the operation of the prior art manual control device, the operator must push directly down on one of the four arms thereby actuating the respective switch. Subsequently, for each change of input, the operator would have to release the previously-depressed arm and push directly down on one of the other arms to actuate a switch. Multiple repetitions of this operation can result in operator fatigue and discomfort, as well as inefficiencies in executing commands.

SUMMARY OF THE INVENTION

It is therefore an object of the present invention to provide a manual control device that is capable of commanding more than four directions.

It is a further object of the present invention to provide a manual control device which can selectively actuate single switches and multiple switches.

It is a further object of the present invention to provide a manual control device that provides two distinct methods of switch actuation.

Toward these and other objects, a manual control device is provided which substantially eliminates or reduces disadvantages and problems associated with prior devices for providing the manual control function. Specifically, a manual control device is provided for selectively actuating one or more switches in a multiswitch system which comprises a plurality of switches disposed in a housing and being actuatable upon engagement, a switch actuator mounted in the housing and defining a plurality of contact surfaces for respectively engaging and actuating the switches, and means for providing limited movement of the actuator in the housing upon manual actuation of the actuator in a manner to permit selective engagement and actuation of the switches by the contact surfaces to provide corresponding outputs, while permitting simultaneous engagement and actuation of selective pairs of said switches to provide different outputs. In an illustrative embodiment, the selective engagement and actuation of individual switches may be used to indicate horizontal and vertical directions, and the simultaneous engagement and actuation of selective pairs of switches may be used to indicate diagonal directions extending between corresponding horizontal and vertical directions.

In another aspect, the means for providing limited movement of the actuator permits initial vertical movement of the actuator relative to the housing, and subsequent tilting movement of the actuator relative to the housing to permit engagement with the switches, the latter tilting movement being less than would be required in the absence of the vertical movement. In an illustrative embodiment, the means for providing limited movement includes a plunger disposed in the housing and engaging the switch actuator to constitute a fulcrum between the actuator and the housing. The manual control device is thus capable of a tilt method of operation in which the operator first pushes directly down on the center of the actuator and then tilts the actuator in the desired direction with improved sensitivity to engage and actuate selected switches.

An important technical advantage achieved with the invention is that the manual control device is capable of actuating individual switches to select individual commands, and is also capable of actuating pairs of switches simultaneously to select other commands. The simultaneous actuation of switches may be an arithmetic sum of the two respective outputs of the respective switches, for example.

An additional technical advantage achieved with the invention is that the manual control device is capable of actuating individual switches to selectively command horizontal and vertical movements, and is capable of actuating pairs of switches simultaneously to selectively command diagonal movements.

An additional technical advantage achieved with the invention is improved efficiency in manual engagement and actuation of selective switches that reduces operator fatigue and discomfort.

An additional technical advantage achieved with the invention is that the availability of both direct and tilt methods of actuation enable the operator to select the sensitivity and speed of hand movements necessary to engage and actuate the switches.

BRIEF DESCRIPTION OF THE DRAWINGS

The novel features believed characteristic of the present invention are set forth in the appended claims. The invention itself, however, as well as other objects, features and advantages thereof will best be understood by reference to the following detailed description of an illustrative embodiment when read in conjunction with the accompanying figures, wherein:

DESCRIPTION OF THE PRIOR ART

Figure 1:
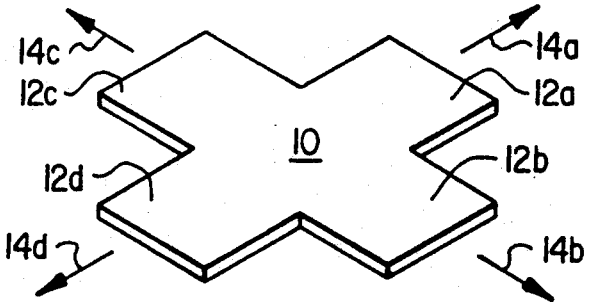
FIG. 1 (PRIOR ART)
FIG. 1 is a perspective view showing an example of a switch actuator used in a manual control device of the prior art.

FIG. 1 depicts an example of a switch actuator, referred to by the reference numeral 10, which forms a part of a prior art manual control device as disclosed in U.S. Pat. No. 4,687,200. The switch actuator 10 is in the shape of a cross having four lever arms 12*a*–12*d* that are adapted to actuate four switches, not shown, respectively disposed beneath the lever arms. Normally, when the lever arms 12*a*–12*d* are not being pressed, the four switches are in an open or nonconductive state. Similarly, if one of the lever arms 12*a*–12*d* is pressed, its respective switch is closed or short-circuited and thereby commands one of four predetermined horizontal or vertical directions, as indicated by four arrows 14*a*–14*d*, respectively. However, the lever arms 12*a*–12*d* are limited to this specific function and no other mode of operation is possible.

In an alternate embodiment of the preceding patent (not shown here), a manual control device is disclosed capable of commanding four predetermined diagonal pressing directions. The four switches are disposed in the same position as the above described embodiment; however, the switch actuator is located such that two switches are closed each time a lever arm is pressed to command the diagonal movements. However, this embodiment cannot provide independent actuation of individual switches. Consequently, although this latter embodiment does improve on the prior art discussed above by providing for the command of diagonal movements it does not provide for the independent actuation of each individual switch to selectively command horizontal and vertical movements.

DESCRIPTION OF THE PREFERRED EMBODIMENTS

Figure 2:
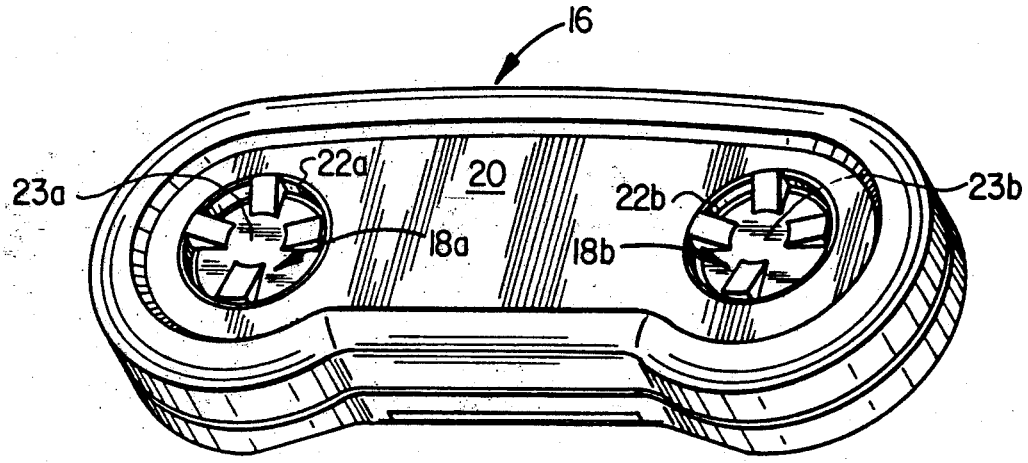
FIG. 2 is a perspective view of an infrared transmitter employing two manual control devices of the present invention.

In FIG. 2 there is depicted an infrared transmitter 16 utilizing two manual control devices 18*a*, 18*b* incorporating features of the present invention. The infrared transmitter 16 includes an oblong housing, or case 20 featuring two circular apertures or openings 22*a*, 22*b* that receive two switch actuators 23*a*, 23*b*, respectively. It is understood that th infrared transmitter 16 controls a video entertainment system, multimedia game device or other type system (not shown) requiring a hand-actuated game playing apparatus, such as the infrared transmitter. in FIGS. 3 and 4, and has a circular top and bottom 24*a*, 24*b*, respectively, that are joined together by a horizontal, annular perimeter, or edge 26. An extensively-flat, annular stop 28 is disposed within the perimeter 26 and forms a portion of the top 24*a*. A vertical side wall 30 is disposed within the annular stop 28 and an upwardly sloping surface 32 extends between the side wall and a flat, circular center portion 34. The circular bottom 24*b* is composed of a side wall 36 sloping down from, and disposed within, the perimeter 26 and an substantially-flat, circular center portion 38 disposed within the side wall. Two tabs 40*a*, 40*b* extend outwardly from the side wall 36 and interlock with two posts 41*a*, 41*b*, respectively, (FIG. 4) that are integral with, and perpendicular to, the case 20. The tabs 40*a*, 40*b* and the interlocking posts 41*a*, 41*b* prevent the switch actuator 23*a* from rotating in the case 20.

Figure 4:
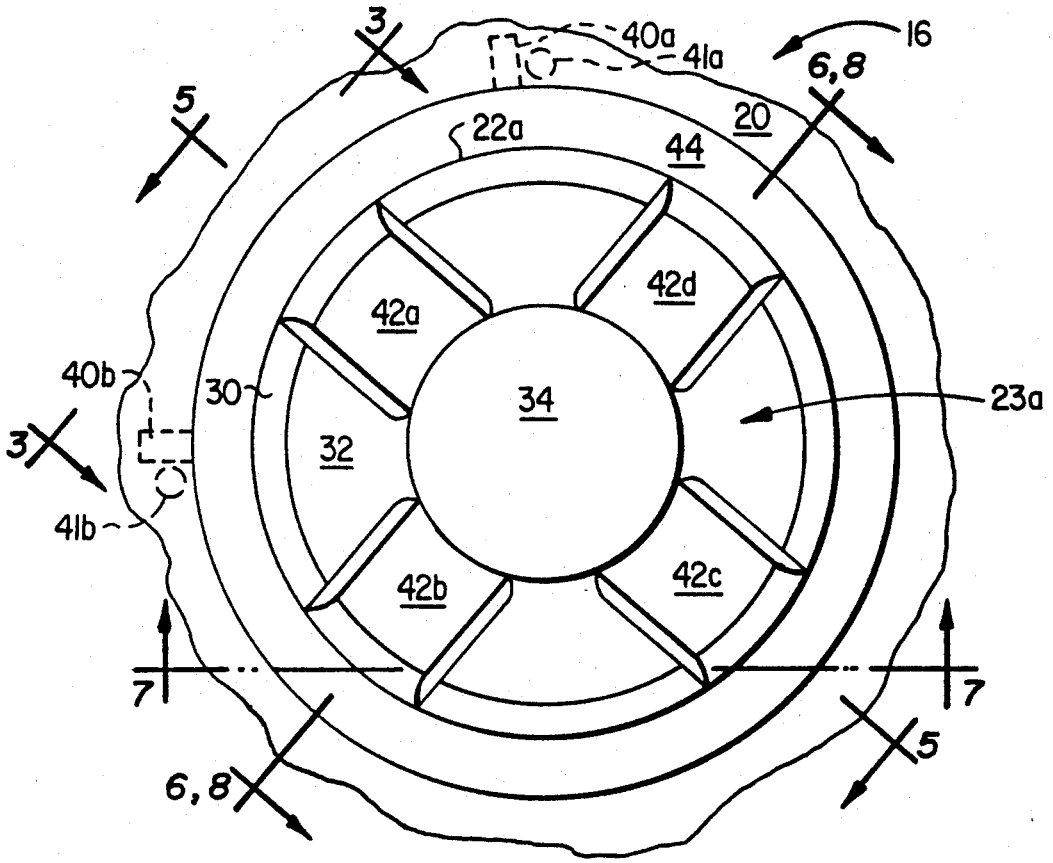
FIG. 4 is an enlarged top view of a manual control device of FIG. 2.
Figure 5:
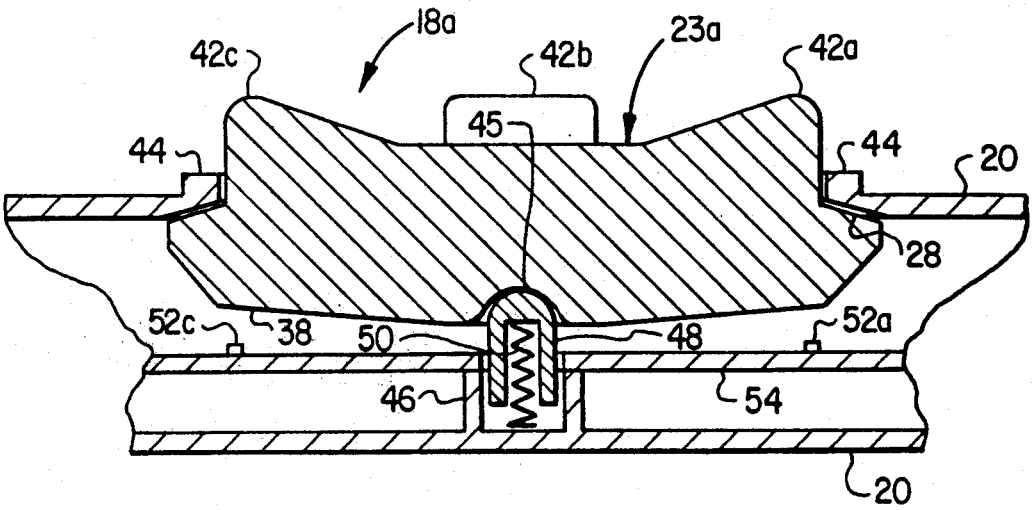
FIG. 5 is a cross-sectional view taken along line 5—5 of FIG. 4.

As shown in FIGS. 4 and 5, the sloping surface 32, the center portion 34, and a portion of the side wall 30 of the actuator 23*a* protrude through the opening 22*a* in the case 20 and four raised key pads 42*a*–42*d* are disposed around the perimeter of the center portion for purposes that will be described later. The case 20 has a reinforced lip 44 to strengthen the portion of the case under which the annular stop 28 rests.

An annular, concave detent surface 45 is disposed in the center of the center portion 38 and a cylindrical plunger guide 46 is disposed below, and concentric to, the detent surface 45 and forms an integral part of the bottom or floor, of the case 20. A hollow sliding plunger 48 is disposed in the plunger guide 46 and its upper end projects from the plunger guide and extends into the detent surface 45. A spring 50 rests on the bottom, horizontal surface of the plunger guide 46 and extends within the plunger 48 to urge the plunger upwardly to force the annular stop 28 of the actuator 23*a* against the lip 44 in such a manner as to hold the actuator 23*a* against the lip when the actuator is in the quiescent state.

A horizontal printed circuit board 54 extends in a spaced, parallel relation to the floor of the case 20 and is disposed above, and suitably attached to, the upper end of the plunger guide 46 with a concentric opening in the circuit board 54 in alignment with the plunger guide. Four switches 52*a*–52*d* (FIGS. 5 and 6) are disposed below and in alignment with the four key pads 42*a*–42*d*, respectively, and are suitably attached to the circuit board 54. The switches 52*a*–52*d* are of a conventional design, such as normally open, single pole-single throw microswitches which are actuatable upon being contacted, in a manner to be described. The plunger 48 extends in such a manner as to limit the overall travel of the actuator 23*a* so that no more than two adjacent switches 52*a*–52*d* be activated simultaneously, as will be described.

Figure 6:
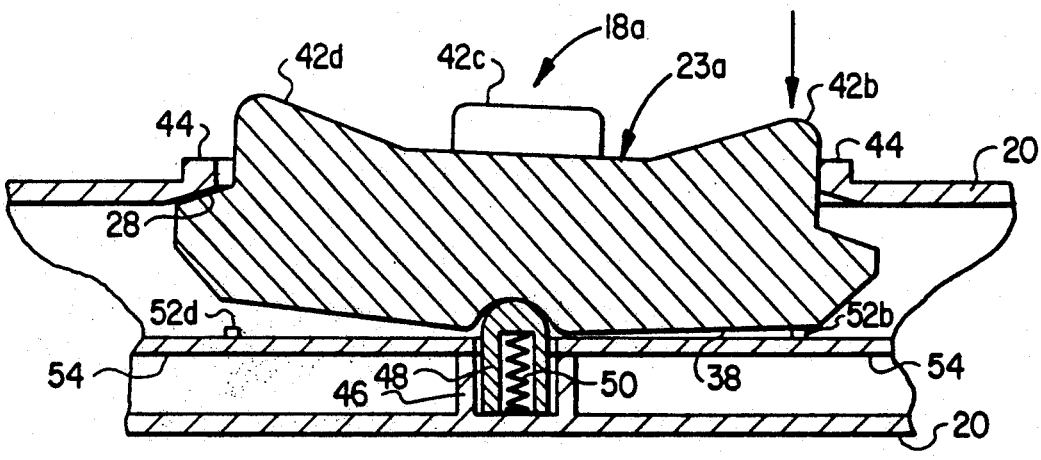
FIG. 6 is a cross-sectional view taken along line 6—6 of FIG. 4.

FIG. 6 illustrates a single switch operational mode in which the operator has pressed directly down on the key pad 42*b* thereby actuating the corresponding rubber dome switch 52*b*. In this mode of operation, the plunger 46 acts as a lateral force stabilizer, a vertical travel limiter, and as a fulcrum or pivotal point about which the actuator 23*a* tilts. The amount of tilting by the actuator 23*a* is limited by the engagement of the corresponding outer surface of the center portion 38 of circular bottom 24*b* of the actuator with the switch 52*a*, by the engagement of the corresponding surface of the annular stop 28 with the lip 44 which is diametrically opposed to the engagement of the portion 38 and the switch 52*a*, and by the engagement of the vertical side wall 30 and the portion of the lip 44 disposed above the switch 52*b*. When the operator releases the pressure applied to the key pads 42*a*, the restoring force, as supplied by the spring 48, returns the actuator to its former inactive position.

Figure 7:
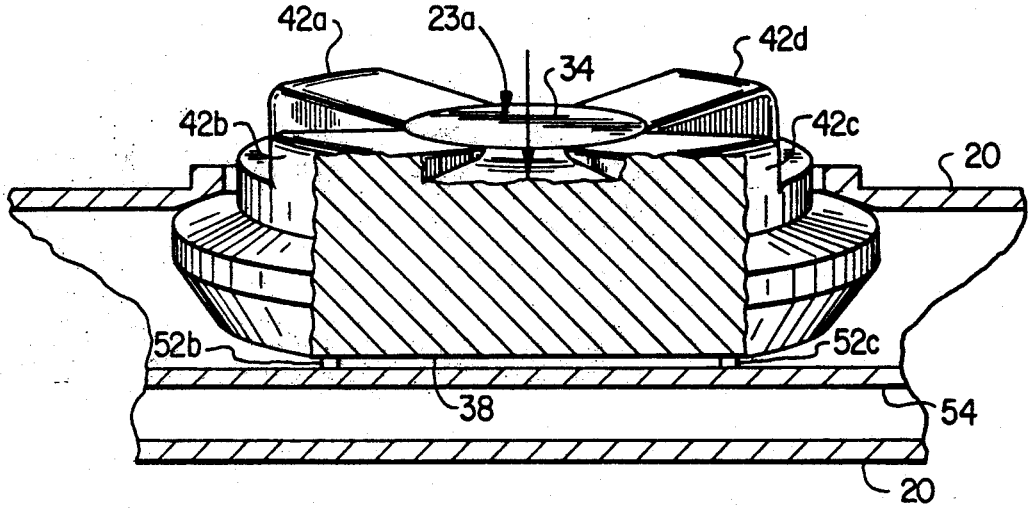
FIG. 7 is a cross-sectional view taken along line 7—7 of FIG. 4.

FIG. 7 illustrates a double switch operational mode in which the operator has applied pressure between the key pads 42*b* and 42*c* thereby actuating the corresponding rubber dome switches 52*b* and 52*c*. In this mode of operation, the plunger 46 again acts as a lateral force stabilizer, a vertical travel limiter, and as a fulcrum or pivotal point about which the actuator 23*a* tilts. The amount of tilting by the actuator 23*a* is limited by the engagement of the outer surface of the center portion 38 of the actuator 23*a* with the switches 52*a* and 52*b*, the engagement of the corresponding surfaces of the annular stop 28 and the lip 44, and the engagement of the lip 44 and the portion of the side wall 30 disposed between the key pads 42*a* and 42*d*. When the operator releases the pressure applied between the key pads 42*a* and 42*b*, the restoring force, as supplied by the spring 48, returns the actuator to its former inactive position.

It is understood, for example, that single switch closures may be used to indicate horizontal and vertical directions and that double switch closures may be used to indicate diagonal directions extending between the two corresponding horizontal or vertical directions. Also, the double switch closure can be the arithmetic sum of the two respective outputs of the respective switches that are closed. The necessary logic for this scheme can be implemented using either hardware, such as with transistor to transistor logic (TTL), programmable logic devices (PLDs), and the like or with software contained in a minicomputer or a microprocessor. As the logical design of switching systems is well-known in the art, it is not shown and will not be discussed further.

In the operation of the manual control devices 18*a*, 18*b*, the operator will have the choice of two distinct modes of actuation, the direct mode and the tilt mode of actuation both of which give the same result. In the direct mode of actuation the operator can push directly down on one of the four key pads 42*a*–42*d*, and thereby actuating the respective switches 52*a*–52*d*, as shown in FIG. 6, and as described above. Further, the operator can push down on the top surface 32 between adjacent key pads and thereby actuate the respective pair of switches, such as the switches 52*b* and 52*c* as shown in FIG. 7, and also as described above. Of course, for each change of input, the operator would release the previously applied pressure and would either push directly down on one of the other four key pads thereby again actuating the corresponding switches 52*a*–52*d*, or apply pressure to the top surface 32 between adjacent key pads and thereby actuate the respective pair of switches.

Figure 8:
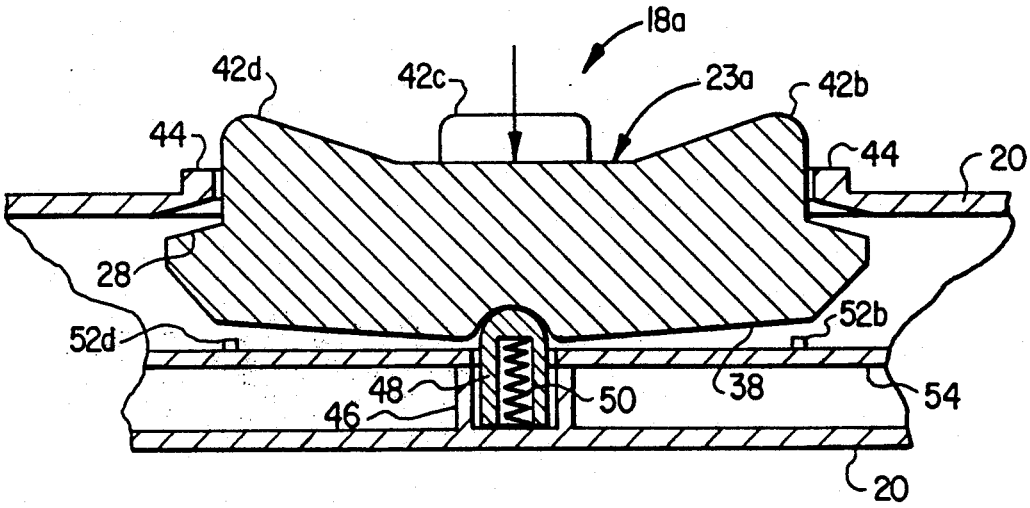
FIG. 8 is a view, similar to FIG. 6 but depicting a different operating mode of the manual control device of FIGS. 2—7.

According to another feature of the present invention, the actuators 23*a*, 23*b* can be operated in the tilt method of actuation in which the operator first pushes directly down on the center of the actuator 23*a* until the spring 48 is fully compressed and the plunger 46 is pressed against the bottom of the case 20 as illustrated in FIG. 8. The vertical displacement of the actuator is limited by the plunger 46 which prevents the actuation of any of the switches 52*a*–52*d*. However, the operator can, subsequently, simply tilt the actuator 23*a* in the desired direction by moving the pressure point slightly off of the center of the actuator 23*a* to actuate the corresponding switch or pair of adjacent switches. To change the input, the operator would simply tilt the actuator in the new desired direction and thereby actuating the respective switch or pair of switches.

The apparatus of the present invention has several advantages over the prior art. For example, the manual control device provides two distinct operational modes, i.e., the single switch mode and the double switch mode which provides the operator with the capability to command not only horizontal and vertical directions, but also, diagonal directions, respectively. Furthermore, the present invention has two methods of actuation, i.e., the direct method and the tilt method. In particular, the tilt method is a substantial improvement or the prior art as it reduces operator fatigue and discomfort since the operator no long is required to release the previous actuated switch, but can simply tilt the actuator in the desired direction in order to command a new direction.

It is understood that several variations may be made in the foregoing without departing from the scope of the invention. For example, the switches utilized by the manual control device may be in the form of potentiometers, or piezoelectric transducers instead of standard contact switches, in order to provide the manual control device with enhanced directional discrimination or other operational features. For example, the use of piezoelectric transducers could be used not only to command x and y axis positioning with enhance directional discrimination, but also to vary the rate in which the x and y axis positioning occurs.

Other variations, modifications, changes and substitutions are intended in the foregoing disclosure and in some instances some features of the invention will be employed without corresponding use of other features. Accordingly, it is appropriate that the appended claims be construed broadly and in the manner consistent with the scope of the invention.

What is claimed is:

1. A manual control device for selectively actuating one or more switches in a multiswitch system, said device comprising a housing, a plurality of switches disposed in said housing and being actuatable upon engagement, a switch actuator mounted in said housing and defining a plurality of contact surfaces for respectively engaging and actuating said switches, and means for providing limited movement of said actuator in said housing upon manual actuation of said actuator in a manner to permit selective engagement and actuation of single ones of said switches by said contact surfaces to provide corresponding outputs while permitting simultaneous engagement and actuation of selective pairs of said switches to provide different outputs, said means for providing limited movement permitting initial vertical movement of said switch actuator relative to said housing and subsequent tilting movement of said actuator relative to said housing to permit said engagement, said latter tilting movement being less than would be required in the absence of said vertical movement.

2. The control device of claim 1 wherein said switch actuator is a single member adapted for movement in said housing to a plurality of switch-engaging positions, each of a first series of positions corresponding to a position for engaging a corresponding switch and each of a second series of positions corresponding to a position for simultaneously engaging a pair of said switches.

3. The control device of claim 1 wherein in each of said first series of directions one of said surfaces engages one of said switches, and in each of a second series of directions one of said surfaces engages two adjacent ones of said switches.

4. The control device of claim 1 wherein said means for providing limited movement comprises corresponding surfaces formed on said switch actuator and said housing which engage when said switch actuator engages with one or two of said switches.

5. The control device of claim 1 wherein said switch actuator includes a central axis and said means for providing limited movement comprises a plunger disposed in said housing which engages said switch actuator along said central axis to constitute a fulcrum between said actuator and said housing.

6. The control device of claim 1 further comprising resilient means disposed in said housing and urging said switch actuator away from said switches.

7. The control device of claim 1 wherein there are four switches each providing a separate output and wherein said device further comprises means for providing an arithmetic sum of two of said separate outputs.

8. The control device of claim 1 wherein said each of said outputs corresponds to movement in a direction and wherein each of said different outputs corresponds to a diagonal extending between the two directions of said two corresponding switches.

9. The control device of claim 1 wherein said switches are normally open and are adapted to be closed upon said engagement.

10. A manual control device for selectively actuating one or more switches in a multi switch system, said device comprising a housing, a plurality of switches disposed in said housing and being actuatable upon engagement, a switch actuator means mounted in said housing and defining a plurality of contact surfaces for respectively engaging and actuating said switches, means for providing limited tilting movement of said actuator means in said housing in a first series of directions to permit selective engagement and actuation of said switches, and for providing limited tilting movement of said switch actuator means in said housing in a second series of directions to permit selective engagement and actuation of pairs of switches, and for permitting initial vertical movement of said switch actuator means relative to said housing and subsequent tilting movement of said switch actuator means relative to said housing to permit said engagement, said latter tilting movement being less than would be required in the absence of said vertical movement.

11. The control device of claim 10 wherein in each of said first series of directions one of said surfaces engages one of said switches, and in each of a second series of directions one of said surfaces engages two adjacent ones of said switches.

12. The control device of claim 10 wherein said means for providing limited movement comprises corresponding surfaces formed on said actuator means and said housing which engage when said switch actuator means engages with one or two of said switches.

13. The control device of claim 10 wherein said switch actuator means includes a central axis and said means for providing limited movement comprises a plunger disposed in said housing which engages said switch actuator means along said central axis to constitute a fulcrum between said actuator and said housing.

14. The control device of claim 10 further comprising resilient means disposed in said housing and urging said switch actuator means away from said switches.

15. The control device of claim 14 wherein there are four switches each providing a separate output and wherein said device further comprises means for providing an arithmetic sum of two of said separate outputs.

16. The control device of claim 10 wherein said each of said outputs corresponds to movement in a direction and wherein said different output corresponds to a diagonal extending between the two directions of said two corresponding switches.

* * * * *

UNITED STATES PATENT AND TRADEMARK OFFICE

CERTIFICATE OF CORRECTION

PATENT NO. : 5,283,401

DATED : February 1, 1994

INVENTOR(S) : Charles Schmucker

It is certified that error appears in the above-identified patent and that said Letters Patent is hereby corrected as shown below:

Column 3, line 65 "that th" should be --that the--

Figure 3:
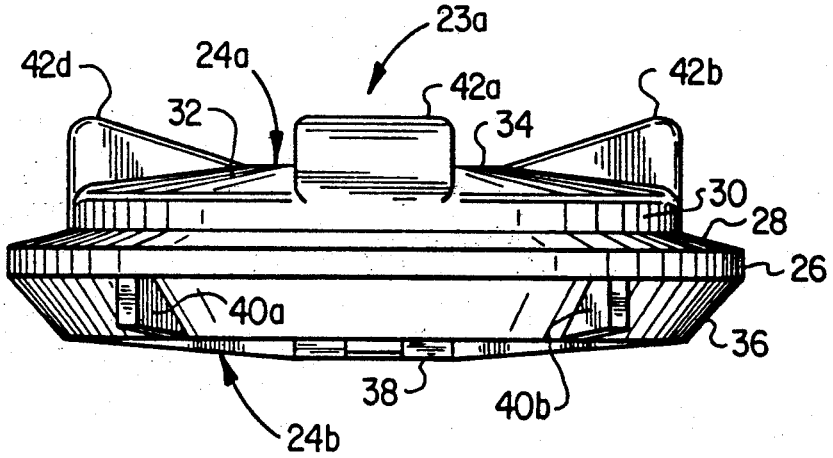
FIG. 3 is an enlarged side view of a switch actuator of the manual control devices of FIG. 2.

Column 4, line 1, "transmitter. in FIGS. 3" should be --transmitter. The switch actuator 23a of FIG. 2 is shown in detail in FIGS. 3--.

Signed and Sealed this

Thirty-first Day of May, 1994

Bruce Lehman

*Attest:*

BRUCE LEHMAN

*Attesting Officer*

*Commissioner of Patents and Trademarks*